United States Patent [19]

Gesing et al.

[11] Patent Number: 4,551,218

[45] Date of Patent: Nov. 5, 1985

[54] ELECTROLYTIC REDUCTION CELLS

[75] Inventors: Adam J. Gesing; John McIntyre; Meine Vandermeulen, all of Kingston, Canada; Edward L. Cambridge, Tucson, Ariz.; Charles J. Rogers, Whitebridge, Australia

[73] Assignee: Alcan International Limited, Montreal, Canada

[21] Appl. No.: 391,410

[22] Filed: Jun. 23, 1983

[30] Foreign Application Priority Data

Jun. 25, 1981 [GB] United Kingdom ..... 8119589

[51] Int. Cl.[4] ..... C25B 3/08

[52] U.S. Cl. ..... 204/240; 204/245

[58] Field of Search ..... 204/243 R, 245, 249, 204/67, 276, 240

[56] References Cited

U.S. PATENT DOCUMENTS 3,475,314 10/1969 Johnston ..... 204/243
3,567,206 3/1971 Heggstad et al. ..... 266/38
3,616,438 10/1971 Foley et al. ..... 204/237
3,666,653 5/1972 De Varda ..... 204/243 R
3,677,926 7/1972 Davis ..... 204/243 R
4,338,177 7/1982 Withers et al. ..... 204/245 X

*Primary Examiner*—Donald R. Valentine
*Attorney, Agent, or Firm*—Cooper, Dunham, Clark, Griffin & Moran

[57] ABSTRACT

In an electrolytic reduction cell in which molten metal is produced by electrolysis of a molten electrolyte, less dense than the molten metal product, the molten product metal collects at the bottom of the cell. A filter is provided at this location and is constructed from a material which is resistant to attack by both the molten metal and molten electrolyte, and which is wetted by the molten metal, but not by the electrolyte. By correcting sizing of the passage or passages in the filter molten metal product can be drawn out of the cell without simultaneous withdrawal of molten electrolyte. In the case of a cell for the production of aluminium the filter is preferably constructed from titanium diboride.

8 Claims, 11 Drawing Figures

ELECTROLYTIC REDUCTION CELLS

Figure 1:
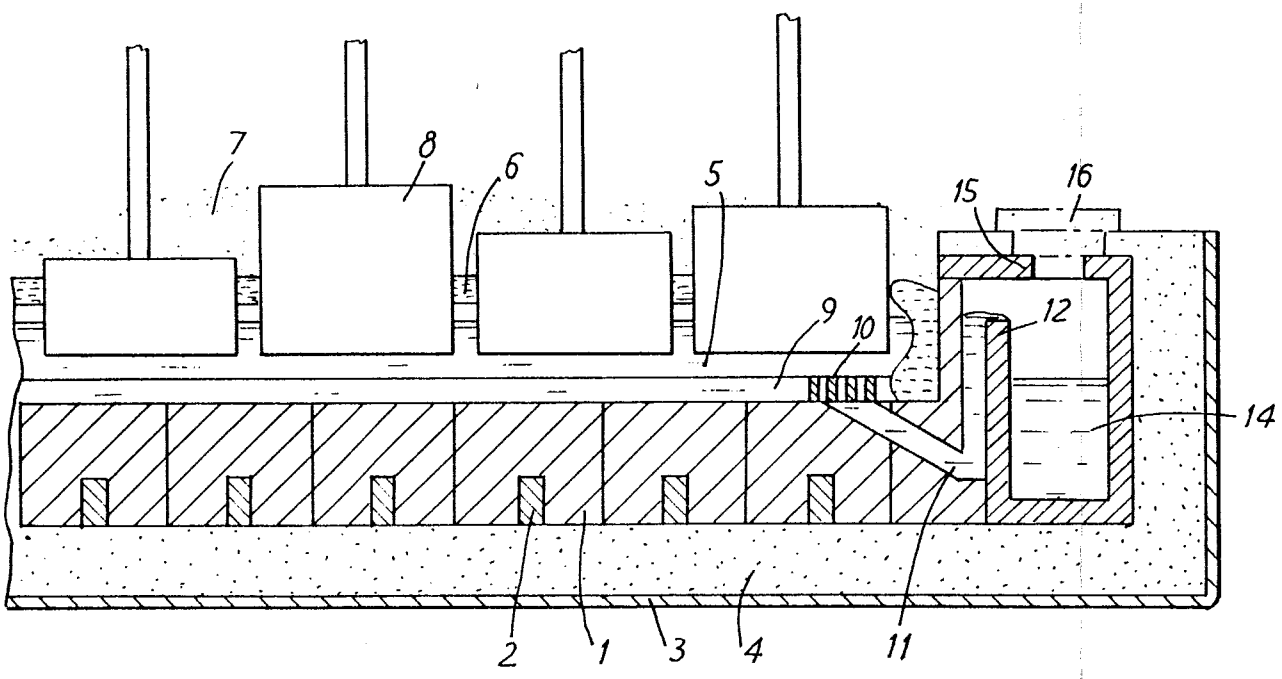

The present invention relates to the construction of reduction cells for the production of metals in molten form by the electrolysis of molten electrolytes. In such systems high inter-facial tension exists between the molten metal and the molten electrolyte and it is an object of the present invention to take advantage of such interfacial tension forces in separating the product metal from the electrolyte.

In one well known example of processes carried out in an electrolytic reduction cell, aluminium is produced by electrolysis of alumina in a fused cryolite electrolyte and the present invention is hereinafter described in relation to that process while being applicable to electrolytic reduction cells in which similar electrolytic reduction processes for production to other metals, which are more dense than the respective electrolytes and involving similar problems, are carried out.

In a conventional electrolytic reduction cell for the production of aluminium the molten electrolyte is contained beneath a crust of frozen electrolyte and feed material. The cathode of the cell lies beneath the electrolyte and is usually constituted by the floor of the cell. The product metal collects at the bottom of the cell and in most instances is the effective cathode of the cell. Product metal is removed from the cell at intervals by a metal tapping operation which is performed by means of a syphon tube inserted through a hole, broken in the crust.

One drawback experienced with conventional electrolytic reduction cells of the present type is that the electro-magnetic forces associated with the very high electric currents flowing through the molten metal and through the current conductors associated with the cell give rise to wave movements in the molten metal, the magnitude of such movements varying with the volume of metal accumulated in the bottom of the cell. The practical effect of such movements is that to avoid intermittent shorting of the cell by contact between the anode(s) and the molten metal it is necessary to maintain a greater distance between the anode(s) and the datum position of the cathode than is theoretically required. The consequence of employing the anode/cathode distance found necessary for a conventional electrolytic reduction cell is the loss of a substantial proportion of the energy input in overcoming the cell electrolyte resistance and very substantial energy savings could be achieved if the cell could be operated with a smaller anode/cathode distance.

It has already been proposed to achieve a reduction in the anode/cathode distance of an electrolytic reduction cell by using a drained cathode structure, in which the effective cathode surface is formed by electrically conductive members which project upwardly from the cell floor and possibly containing a small body of molten aluminium, the molten metal product collecting between such members or being allowed to drain away into a tapping well of the cell, from which it displaces cell electrolyte. In such a case the change in the electrolyte level as a result of a tapping operation is much greater (because of the relatively small area of the electrolyte surface in relation to the surface of the anode(s)) than in a more conventional cell arrangement and the large change of electrolyte level leads to operating difficulties. In the case of a drained cathode arrangement, the liquid levels could be maintained constant or nearly so if a method could be found for removing the product metal from the cell either continuously or in small batches at frequent intervals.

It is an object of the present invention to provide such a method and to construct an electrolytic reduction cell in which such a method can be used.

According to the invention a reduction cell is provided with a filter which under the operating conditions of the cell permits the product metal to flow through it but acts as a barrier to the electrolyte. The principle of operation is to construct the filter of a material which is preferentially wetted by the molten metal and to size the apertures in the filter to such a value that the interfacial tension forces in the molten metal/electrolyte system, resisting the flow of electrolyte through such apertures, are higher than the maximum driving force acting on the electrolyte at the filter. Such driving force is the difference between the gravitational force acting on the electrolyte on the inlet side of the filter and the back pressure exerted on the molten metal on the outlet side of the filter. It is necessary to maintain a back pressure on the outlet side of the filter to ensure that the filter apertures remain filled with molten metal. However for that purpose it is sufficient to maintain a column of molten metal downstream of the filter by providing an overflow weir in a passage leading from the filter to a molten metal draw-off container. Alternatively the metal flowing out of the filter may enter an enclosed draw-off container, which may be pressurised to maintain adequate back pressure at the filter.

From theoretical calculations, based on 20 cm electrolyte depth, it can be shown that for a filter with circular apertures of 5 mm diameter for a molten fused salt electrolyte (density 2.1) the columnar height on the upstream side of the filter could exceed the molten aluminium (density 2.27) columnar height on the downstream side of the filter by more than 30 mm, before the electrolyte would start to flow. This allows the filter to be constructed of robust material and ensures that it does not present an objectionable restriction on the relatively slow flow of molten metal, required to remove the product metal at the rate at which it is formed in the cell. The value of the electrolyte head which can be retained on the upstream side of the filter varies substantially in inverse ratio with the diameter of the aperture(s) in the filter. For a filter aperture of 10 mm diameter the value of the supportable column of electrolyte falls to about 20 mm and that is probably the lowest value that can be considered for practical application, bearing in mind the changes in electrolyte head which occur during cell-operation as a result of vertical electrode movements and introduction of batches of fresh feed material at intervals.

The surfaces of the filter must be resistant to attack both by the molten metal and the molten electrolyte and also must be wetted by the molten metal and not by the electrolyte. It is found that in the case of molten aluminium and conventional fluoride electrolyte these requirements are met by, for example, titanium diboride, $TiB_2$ and other borides, such as zirconium diborides and niobium diborides and other similar substances which are generally known as refractory hard metals. The filter may be formed wholly of such materials or alternatively a coating of such material may be applied to a ceramic base, such as fused alumina, or a strength-providing metal base.

The filter may take a variety of forms such as apertured plates, honeycomb grids, parallel bars, ceramic cloths, ceramic felts, packed beds of correctly sized particles. However structures with openings of substantial size and of robust construction, such as arrays of parallel bars, apertured plates, honeycomb grids or packed beds, are preferred.

While the filter apertures are preferably round holes of 2–4 mm diameter or essentially rectangular slits with a minor dimension of about 2–3 mm it is possible to employ holes of 5 mm diameter or even higher where it is possible to operate the cell with a lesser excess columnar height of electrolyte. It may on the other hand be preferred to operate in some cases with apertures in which the diameter or minor dimension is as low as 1 mm or even lower in some instances.

The open area of the filter (or total open area of the filters, where more than one filter is provided in the cell) must be sufficient to permit passage of the product metal at the rate at which it is produced in the cell. However it is estimated that in most cases a single 2 mm diameter aperture will be sufficient to drain off the whole aluminium metal product of a commercial electrolytic reduction cell. To avoid clogging problems the filter is preferably provided with 10 or more apertures, spaced apart, and more usually it will be preferred to employ apertures in the range of 3–4 mm diameter. Where the filter is constituted by particles, such as $TiB_2$ balls, these may range in size up to 10 mm and the bed will normally range in depth from 5–50 mm, according to the diameter of the particles.

The invention is applicable to electrolytic reduction cells of conventional type, in which the cathode is constituted by flat-topped carbon slabs. In such case the top surface of the filter is maintained slightly above the level of the floor of the cell so as to maintain a shallow pool of molten metal over the floor of the cell to obviate contact between the electrolyte and the carbon floor.

The invention is particularly applicable to the continuous removal of molten metals from cells employing drained cathodes, particularly cells in which the floor is covered by a layer of metal-wetted shapes, which reduce the tendency of wave motion in the product metal.

The invention is illustrated in the accompanying drawings, in which

Figure 2:
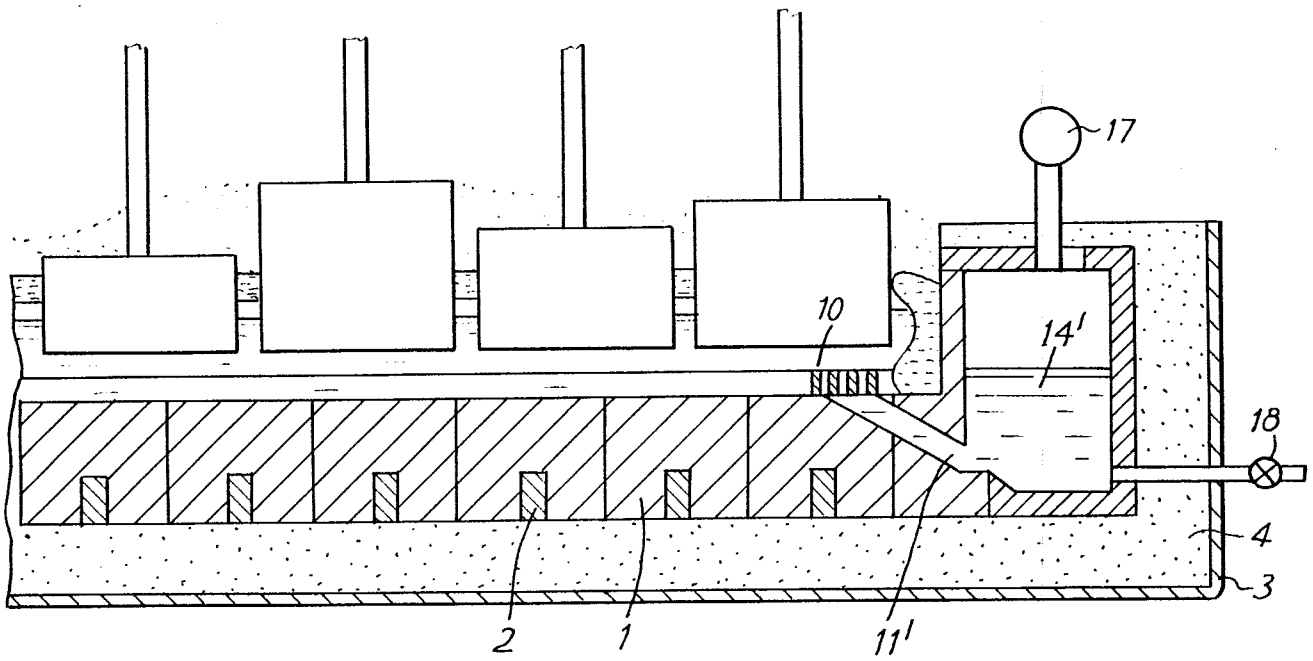
Figure 3:
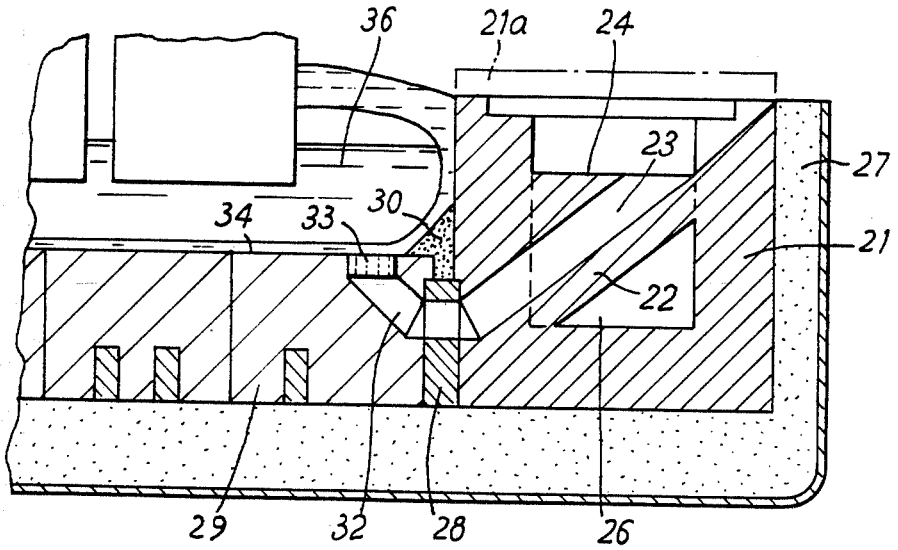
Figure 4:
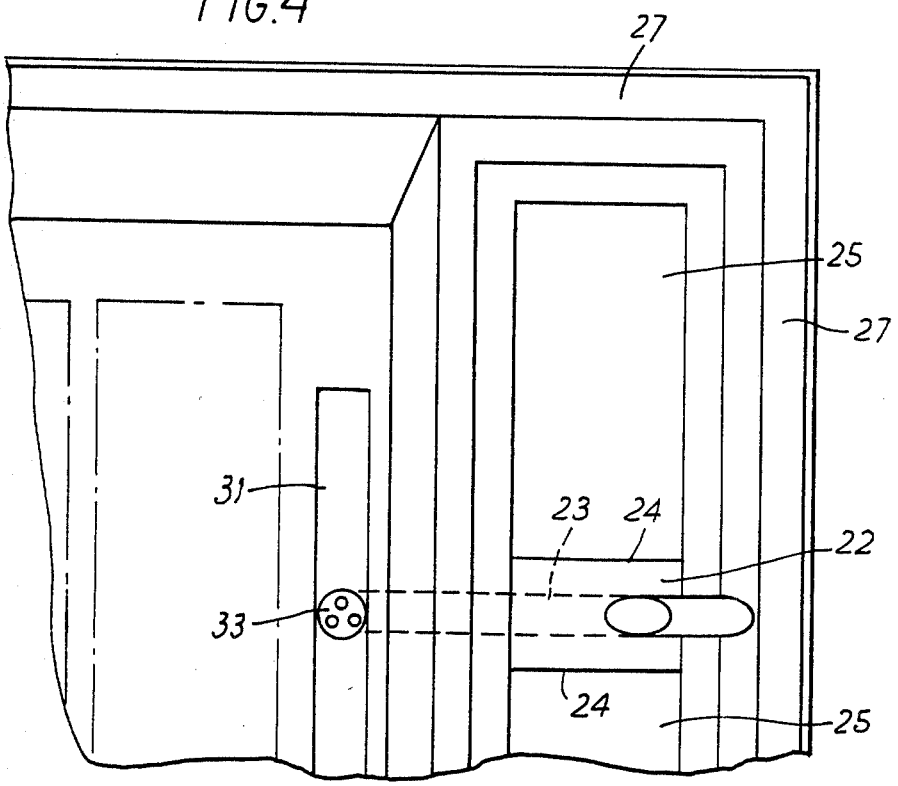
Figure 5:
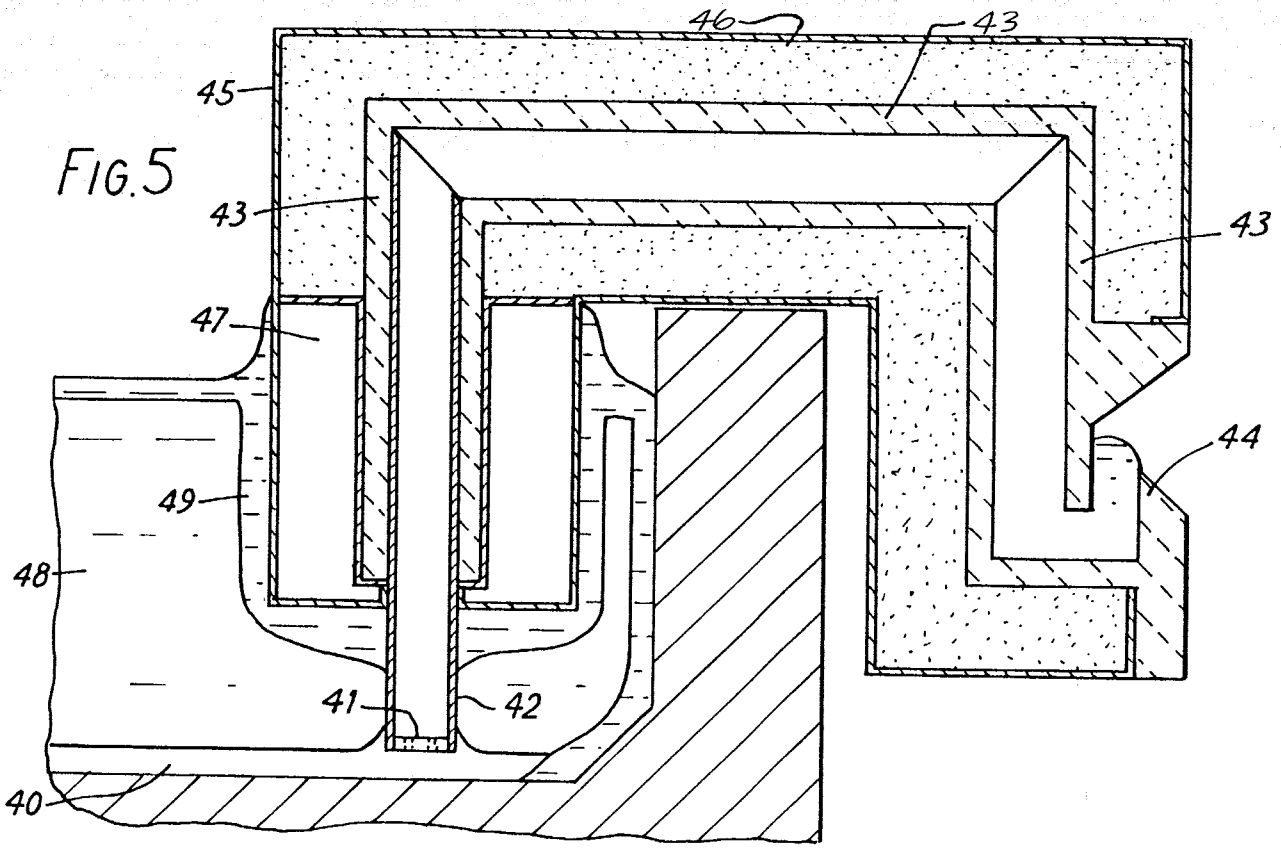
Figures 6, 7:
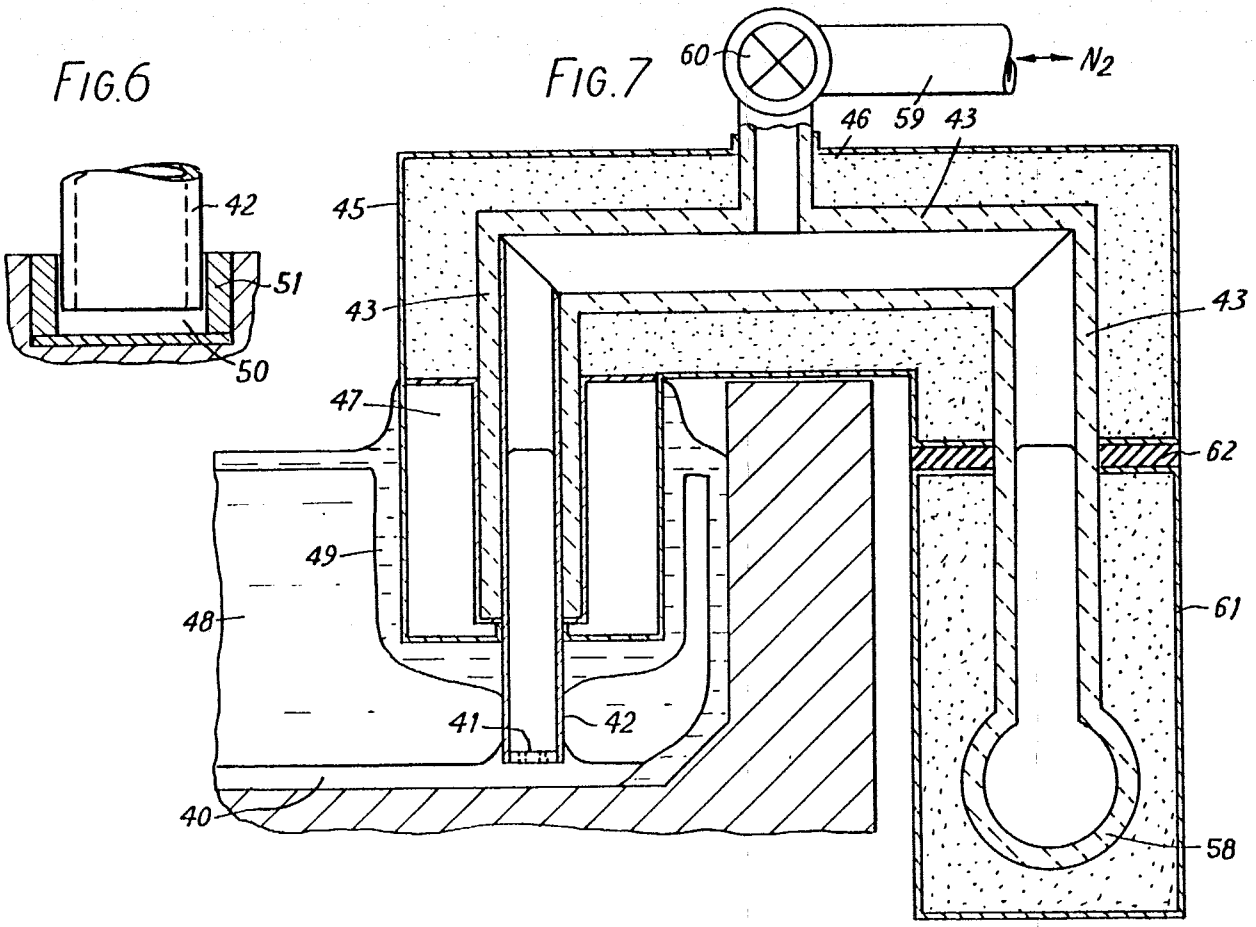
Figure 8:
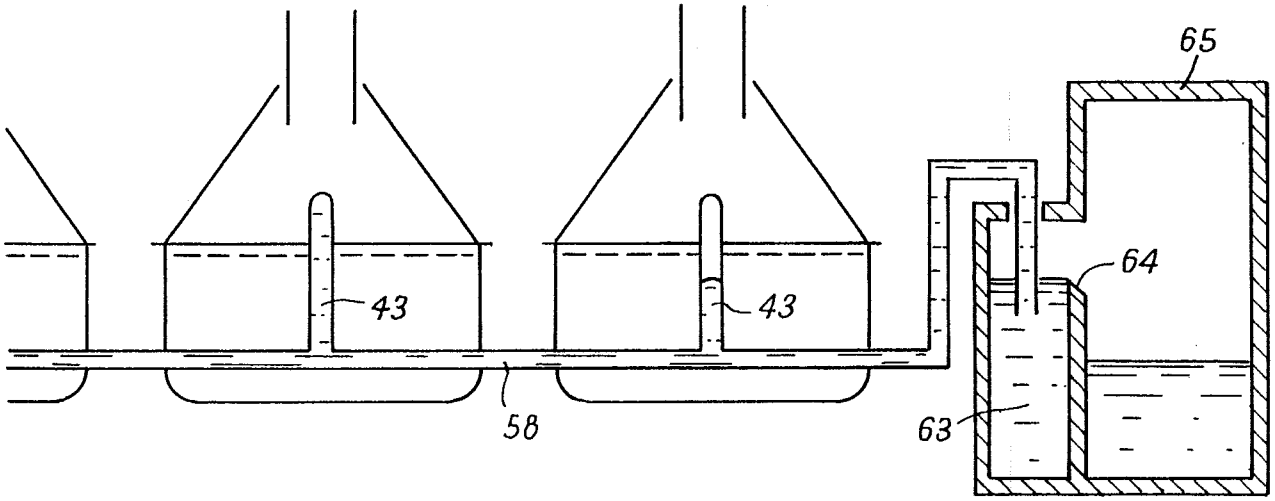
Figure 9:
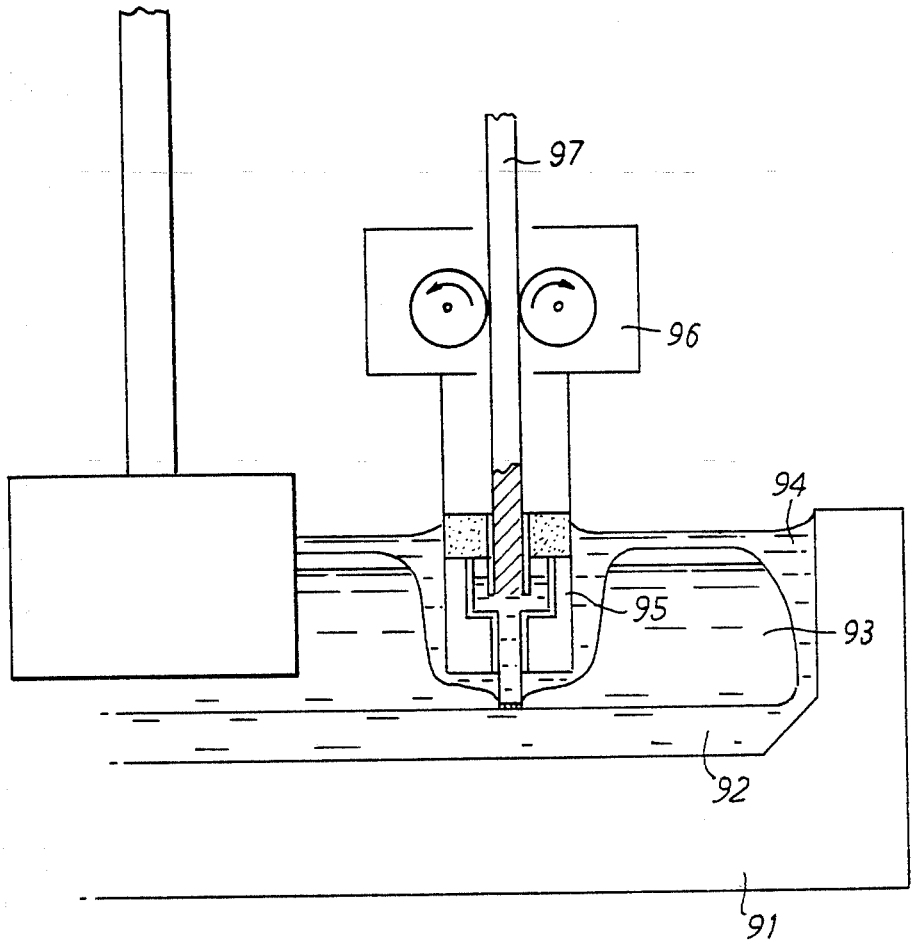
Figure 11:
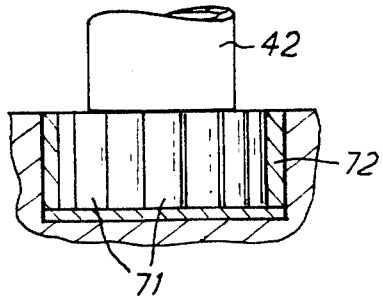
Figure 10:
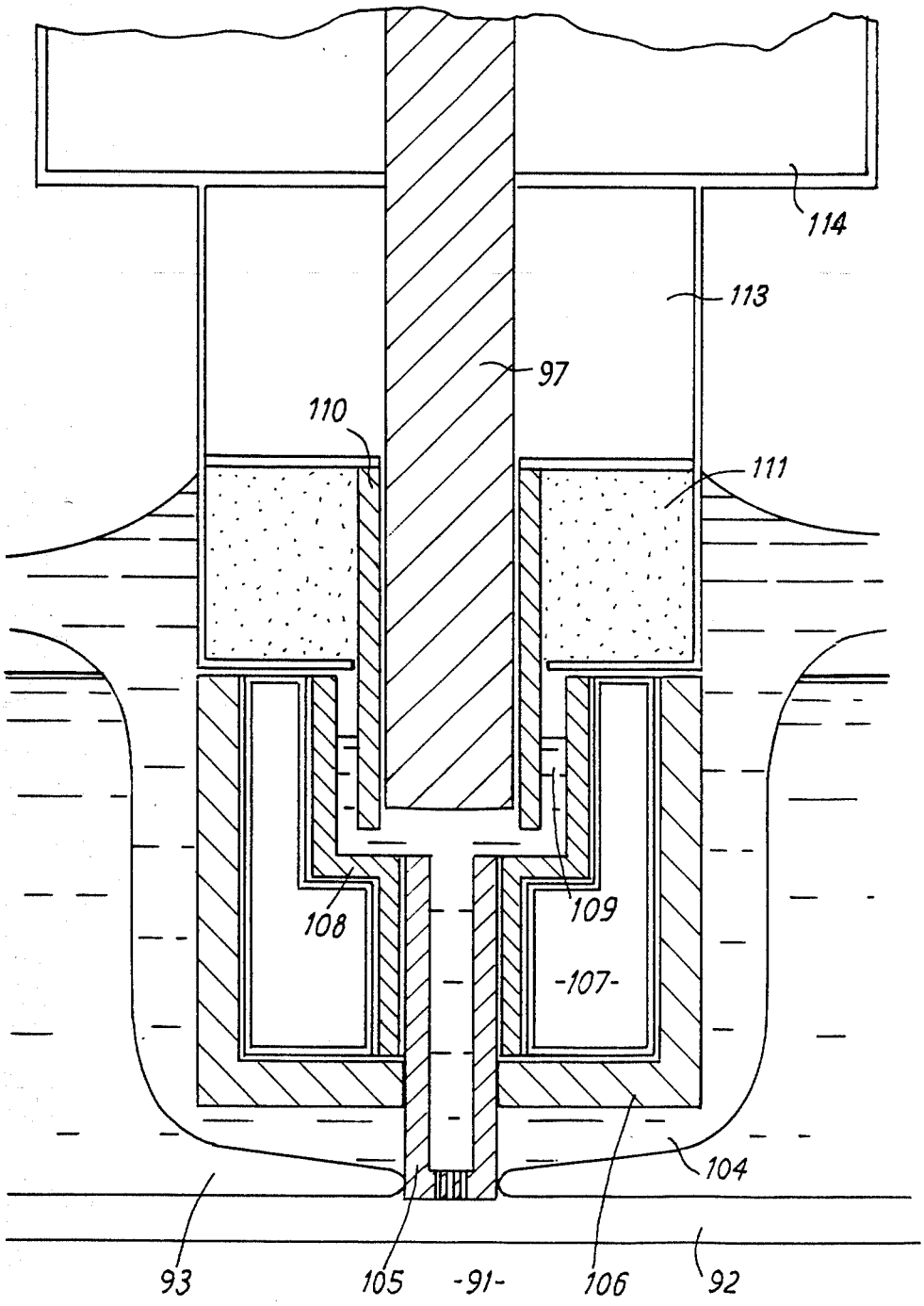

FIG. 1 is a diagrammatic longitudinal section of one form of electrolytic reduction cell in accordance with the invention, FIG. 2 is a similar view of a modified form of cell, FIG. 3 is a sectional view of a filter similar to the filter of FIG. 1, but in greater detail, FIG. 4 is a plan view of rhe filter of FIG. 3, FIG. 5 is a sectional view of an alternative form of filter arrangement, FIG. 6 is a sectional view of a modified form of the filter of FIG. 5, FIG. 7 is a sectional view of a modified form of the apparatus of FIG. 5 in which metal is tapped into a hot metal pipeline, FIG. 8 is a sketch showing a series of cells tapped using the system of FIG. 7, sharing a single outlet metal level control unit, FIG. 9 is a sectional view of a metal selective filter withdrawing metal from the reduction cell directly into an ingot pulling device, FIG. 10 is a sectional view showing details of the system of FIG. 9, FIG. 11 is a sectional view showing a further modified form of the filter of FIG. 5.

In FIG. 1 the cell includes carbon cathode floor blocks 1, each provided with a conventional steel collector member 2 for connection with the cell bus bars. The cell includes a conventional steel shell 3 and insulation (thermal and electrical) 4 and contains a bath of conventional molten fluoride electrolyte 5, covered with a frozen crust layer 6 and powdered alumina feed 7 in a conventional manner. Prebaked carbon anodes 8 are suspended in conventional manner to contact the molten electrolyte 5 and are spaced from a cathode layer 9, which may be constituted by molten metal and/or electrically conductive refractory material, such as $TiB_2$. A filter structure 10, of one of the types already discussed, is positioned to drain off molten product metal overflowing from the layer 9.

A passage 11 leads from the downstream side of the filter 10 to an overflow weir 12 arranged so as to maintain a positive pressure of molten metal against the underside of the filter 10, but the level of the weir 12 is arranged so that in normal operation the level of the molten electrolyte 5 lies substantially above it.

The molten metal, overflowing the weir 12, enters a collection chamber 14, from which a batch may be syphoned off at desired intervals through an aperture 15, normally maintained closed by a removable cover 16. The chamber 14 may be provided with a heater (not shown) to make good the heat losses from the collected metal. The removal of a batch of metal has very little effect on the conditions within the cell. The cell illustrated in FIG. 2 is identical with the cell of FIG. 1 at all locations upstream of the filter 10. Downstream of the filter 10 the product metal flows through a passage 11' into a collection chamber 14', which is totally enclosed and has a head space into which gas under pressure may be introduced from a pump 17 or other gas pressure source. A batch of metal may be drawn off from chamber 14' via a tap 18 while gas under pressure is introduced simultaneously into the head space of chamber 14' to maintain a substantially constant pressure of molten metal on the underside of the filter. The gas pressure may be progressively released from chamber 14' as fresh molten metal flows in from the cell.

FIGS. 3 and 4 illustrate in somewhat greater detail a filter apparatus of the type shown in FIG. 1 fitted into one end of an existing electrolytic reduction cell.

At one end of the cell a preformed graphite reservoir vessel 21 is installed within the outer shell of the cell and seated on the existing cell insulation. The vessel 21 is provided with a central partition 22, in which is formed an inclined metal flow passage 23. The partition 22 provides weirs 24 for metal flowing upwardly through passage 23 to allow it to spill over into metal collection troughs 25 on both sides of the partition 22.

The partition 22 is preferably provided with an internal space 26, filled with thermal insulation as indicated to reduce heat losses from the metal in passage 23. The vessel 21 is provided with insulating removable cover sections **21*a*, partially recessed into the top of the vessel, and is surrounded with an insulating layer 27** around three sides.

The vessel 21 abuts a sealing block 28, made of graphite or like material, which is recessed into the wall of the vessel 21 and the adjacent floor block 29 of the electrolytic cell. A layer 30 of conventional pitch/carbon ramming mix seals off the junction between floor block 29 and vessel 21 to prevent entry by electrolyte.

In the floor block 29 a very shallow transverse channel 31 leads to the mouth of a downwardly inclined passage 32, in the mouth of which an apertured filter plate 33 is seated. The filter plate is formed of titanium diboride and is preferably 5–20 cms diameter with a series of apertures therein of a diameter in the size range 2–5 mm.

The top surface of the filter plate 33 is preferably arranged at such a level that in normal operation a very shallow pool 34 of molten Al metal is maintained above it. The weirs 24 are arranged at such a level that a slight positive head of electrolyte is maintained to drive the molten Al through the filter throughout the range of operating levels of the electrolyte 36 in the bath. In a typical electrolytic cell the depth of the electrolyte bath may vary up to 25 mm during anode-effect quenching operation by anode pumping (up and down movement of the anodes). Consequently the height of the weirs 24 and the diameter of the apertures in the filter plate 33 are matched to ensure that, at the maximum level of the electrolyte, the filter plate will restrain passage of the electrolyte. However to guard against the possibility of sludge, consisting of admixed alumina particles and electrolyte and of a bulk density greater than molten Al, being pulled through the filter under conditions of abnormal electrolyte level, due to incorrect operation of the cell, the straight upwardly inclined passage 23 permits such sludge to be removed from the trap formed by the junction of the passages 23 and 32.

As will be appreciated from earlier discussion of the invention the plate-like filter elements 10 of FIGS. 1 and 2 and the filter element 33 of FIG. 3 may be replaced by a body of metal-wettable ceramic particles of appropriate size and preferably located in a vertical well, from which molten metal is led out through an upwardly inclined passage.

In FIG. 5 an alternative arrangement is shown for drawing off product Al metal from an electrolyte reduction cell without substantial modification of the structure of the cell.

In this arrangement molten metal is drawn from a shallow pool 40 of molten metal in the bottom of the cell. The apparatus is arranged to maintain the depth of the pool 40 at about 50–100 mm. In this case a filter plate 41, essentially identical in construction to the filter plate 33, is located in the bottom end of a vertical syphon tube 42, formed of titanium diboride. The tube 42 leads up into an alumina conduit 43 which carries the metal to an overflow weir 44. From the weir 44 the metal splashes over into an enclosed, thermally insulated vessel (not shown).

The titanium diboride tube 42 and alumina conduit 43 are contained within an outer steel shell 45. The horizontal and downwardly directed sections of the conduit 43 are surrounded by thermal insulation 46 to hold the contained metal above solidification temperature. An air cooled chamber 47 is provided in the lowermost portion of the steel shell 45, where it dips into the cell electrolyte 48. The purpose of the air cooled chamber 47 is to provide for the formation of a solidified protective layer 49 of electrolyte 48 to cover the immersed portion of the steel shell 45, without at the same time causing excessive cooling of the metal stream in the tube 42, which is also thermally insulated by the surrounding section of the alumina conduit 43.

As in the construction of FIGS. 3 and 4 the height of the weir 44 and the size of the apertures in the filter plate 41 are determined by the upper and lower limits of the depth of the electrolyte 48 in normal cell operation.

It is necessary to provide suction to the syphon in order to start and restart the tapping procedure. In the system of FIG. 5 suction may be applied at the syphon outlet by making an air-tight seal with the collection crucible within which reduced pressure is applied. Syphoning may be stopped by applying positive pressure of air or gas to the interior of the crucible.

In the further alternative construction illustrated in FIG. 6 all other parts of the apparatus as identical to the construction of FIG. 5.

In FIG. 6 the tube 42 is somewhat extended in length and its lower end is located within a shaklow well 50 in the cell floor. The well 50 is of a depth of about 5 cms and the tube 42 terminates at about 2 cms above the bottom of the well. The well 50 is lined with a metal wettable ceramic (e.g. $TiB_2$) 51. The clearance between the syphon tube 42 and the side wall of the well is sized so as to restrict the entry of the molten electrolyte but to allow the passage of the molten Al metal.

For a syphon tube of 10 cm external diameter the maximum acceptable clearance between the syphon tube and the side wall is 1 cm, but more preferably the clearance is 1–2 mm, since that will support a larger head of electrolyte. Increase or decrease of syphon tube diameter will require decrease or increase of the clearance respectively to maintain a given height of electrolyte column. However the clearance would be of the same order of magnitude for syphon tubes of sizes likely to be employed in practice.

In FIG. 7 a modified form of the apparatus of FIG. 5 is shown. In FIG. 7 identical elements are identified by the same reference numerals. In FIG. 7 the syphon outlet is connected to a hot metal pipeline 58 into which metal, withdrawn from the cell, is directly discharged. The pipeline is heated by electrical resistance heaters (not shown) to maintain the flowing metal in a molten condition, and carries the metal directly to a holding or casting furnace.

In the apparatus of FIG. 7 the withdrawal of metal through the filter 41 is not continuous and in this apparatus a suction tube 59 communicates with conduit 43 via an on-off valve 60. Suction applied via tube 59 may be used to draw up metal from the reduction cell to start the syphon operation. Nitrogen or other suitable inert gas may be admitted via tube 59 to break the syphon action. It will be seen that the steel casing 61 for the pipeline 58 is electrically insulated from the casing 45 by electrical insulation 62.

When the syphon is inoperative the molten metal will be retained at the level indicated in the up-tube 42 by the action of the selective filter 41, whereas in the down leg of conduit 43 the metal will preferably be maintained at the indicated level by a weir in the pipeline 58.

Metal level control may in fact be achieved by providing individual overflow weirs for each cell as in the system of FIG. 5. However it is preferred to provide, as indicated, a single outlet overflow weir serving a group of cells or all the cells in the potline. FIG. 8 illustrates such a system. The cells are tapped one by one into the pipeline 58 through metal selective syphons, constructed as shown in FIG. 7. The syphons are started individually by applying suction and stopped by injecting gas via suction tube 59.

As indicated in FIG. 8 the syphon tube/conduit system of the left-hand selective syphon is operating and is full of metal while the right-hand selective syphon is inoperative, in common with all other selective syphon systems leading into the same pipeline 58.

The metal in the pipeline 58 syphons into a receiver 63 and flows over weir 64 into a holding furnace 65.

Only one cell is tapped at a time to prevent electrical short-circuting between the cells. The preferred syphoning speed in this system would be approximately 500 $cm^3/s$. so that more openings in the filter would be necessary to accommodate the increased flow (e.g. 50 to 100 2 mm. dia. openings).

Syphoning of any individual cell would no longer be continuous but, with complete automation of the system, the interval between tappings could be as low as 60 min. In such a case the volume of metal withdrawn per tapping would be less than 20 liters, corresponding to a tap duration of 40 sec. or less and a change of level of metal of about 8 mm. in the cell.

FIGS. 9 and 10 show a metal selective filter arranged to withdraw molten metal from an electrolytic reduction cell directly into an ingot pulling device. The ingot or crystal pulling method of melt solidification is already known.

The generesl concept of the apparatus is shown in FIG. 9 which shows an electrolytic cell 91 containing a pool of molten metal 92 and molten electrolyte 93 which forms a solid protective crust 94 on the surface and along the side walls. The metal is withdrawn from the cell into the ingot puller 95 through a metal selective filter, preferably at such rate as to maintain a constant level of metal in the metal pool 92. The ingot 97 is withdrawn by the mechanical drive 96. The construction of the metal selective filter may take any of the forms already discussed.

FIG. 10 shows the details of the ingot puller 95. Molten metal enters the ingot puller through a refractory boride ceramic tube 105 which has selective filter openings located in its bottom end.

Molten metal flows upwardly through tube 105 and enters a high-alumina crucible 108 which is maintained at approximately ~700° C. by air passing through a steel compartment 107 which is in turn protected from chemical attack of the molten electrolyte by an external layer 106 of carbonaceous material. Electrolyte forms a solid crust 104 and protects the carbon lining in much the same way as it protects the cell side walls. Molten metal contained in the alumina crucible 108 is preferably protected from air oxidation by a layer 109 of low melting salt having low solubility for alumina. An alumina tube 110 is immersed into the metal and serves to define the size and shape of the ingot 97 being pulled by the drive 96. The exterior surface of the alumina tube 110 is coated with a refractory boride in order to make it preferentially wetted by molten Al metal and prevent the molten salt 109 from entering the tube 110. A layer of thermal insulation 111 ensures that the main heat flow out of the crucible 108 is through the ingot being pulled, for control of the position and the shape of the freezing interface. The position of the interface is determined by the rate of heat withdrawal through the ingot, which in turn, is controlled by the amount of heat removed from the solidified ingot in the air cooling chamber 113. The mechanical drive for ingot withdrawal is located in a housing 114. The required rate of withdrawal may be calculated from the rate of metal production and current efficiency of a particular cell. Fine tuning of the withdrawal rate can be obtained by monitoring the relative levels of the cell electrolyte 93 and molten salt 109. Since electrolyte 93 cannot pass through the filter 105 if the metal level in the cell is too low, the electrolyte level will remain constant while the level of the molten salt 109 will drop as the metal is withdrawn from the crucible 108. If the rate of withdrawal is too slow, on the other hand, metal level will build and cause a rise in the level of both the electrolyte 93 and the molten salt 109.

The diameter of the ingot to be pulled and therefore the diameter of tube 110 depends on the balance of the rate of heat flow up the ingot and the enthalpy of solidification of the metal. For a 100 KA cell with a pulling rate of 1 cm/min, 14.4 m long ingot, having 15 cm diameter would be produced in 24 hours.

In the construction of FIG. 11 the tube 42 rests on the top of an assemblage of cylindrical $TiB_2$ rods 71 contained within a $TiB_2$-lined well 72. The tops of the rods 71 are level with the molten metal/electrolyte interface in the cell. The metal flows downwardly between the outer rods and upwardly through the inner rods facing the mouth of the syphon tube. This arrangement may be in some circumstances be preferred where intermittent tapping procedures require greater flow rates, because the entrance to the syphon tube is unobstructed, as compared with the construction of FIG. 8.

It will be appreciated that in this construction the rods 71 may be replaced by $TiB_2$ spheres.

In an electrolytic reduction cell the rate of production of metal is low in relation to the volume of molten electrolyte in the cell and the system can be considered as being essentially static.

The maximum static head of electrolyte which can be retained on a titanium diboride filter plate arranged in an electrolytic reduction cell as shown in the apparatus of FIGS. 3–5 is dependent on the diameter of the apertures in the filter plate and can be calculated from the following formula:

$$h_1 = \frac{1}{\rho_1 g}\left(\frac{2\gamma}{r} + (\rho_2 - \rho_1)\, g \cdot h_2\right)$$

where $h_1$ is the height of the electrolyte column above the overflow weir
$h_2$ is the height of the electrolyte column below the weir
$\rho_1$ is the density of the electrolyte
$\rho_2$ is the density of the molten metal
$\gamma$ is the interfacial tension at the metal/electrolyte interface
r is the radius of the filter apertures
g is the gravitational constant.

Calculations made from the available date indicate that the value of $h_1$ varies from about 120 mm for a 1 mm diameter aperture to about 30 mm for a 5 mm diameter aperture, for the case where $h_2$ was 200 mm.

Experiments performed with a simple test rig yield results which concur closely with the calculated values e.g. $h_1 = 27$ mm for 4 mm diameter aperture and $h_2 = 0$. It can be concluded that the above formula is valid for other metal/electrolyte systems where the molten electrolyte is less dense than the molten metal and the filter plate is preferentially wet by the molten metal.

A method for measuring the value of the interfacial tension at a molten metal/molten electrolyte interface is described in Met Trans 8B, (1977) 551–561 (Deslaux, P. and Dewing, E. W.).

The value of the static head of electrolyte supportable by a selective filter of the present invention, where the filter apertures are non-circular can be determined by practical experiment or by appropriately developed formulae.

We claim:

1. In an electrolytic reduction cell of the type in which a molten product metal is produced by electrolysis of a fused electrolyte which is less dense than the molten product metal the improvement which comprises a filter located in a product metal accumulation region over the floor of the cell, said filter being formed of a material which is resistant to attack by both the molten product metal and the fused electrolyte and which is wettable by the molten product metal and is non-wettable by said electrolyte, said filter having at least one passage therethrough sized to permit flow of molten metal therethrough, but to restrain flow of molten electrolyte under the maximum driving force acting on the electrolyte at the filter, means being provided for maintaining a back pressure of molten metal at the outlet side of the filter.

2. A reduction cell according to claim 1 in which said filter is a plate-like member formed of a refractory hard metal and has at least one metal-flow passageway formed therein.

3. A reduction cell according to claim 2 in which said filter is arranged for upward passage of molten metal therethrough.

4. A reduction cell according to claim 3 further including means for solidifying metal at a location adjacent to, but spaced from, the downstream side of the filter and for withdrawing said solidified metal at a controlled rate and thereby drawing molten metal through the filter at such rate.

5. A reduction cell according to claim 1 in which said filter is constituted by a pair of concentric refractory hard metal members having a restricted annular slit between them.

6. A reduction cell according to claim 1 in which said filter is constituted by a plurality of separate, appropriately sized hard metal members defining electrolyte flow-restraining passageways between such members.

7. A reduction cell according to claim 1 further including an upwardly directed metal flow passage on the downstream side of said filter, said passage leading to an overflow weir arranged intermediate the level of the filter in said cell and the minimum electrolyte level, said weir serving to maintain continuous contact between said filter and molten metal on the downstream side of the filter.

8. A reduction cell according to claim 1 further including an upwardly directed metal flow passage on the downstream side of said filter and means for applying controllable reduced pressure conditions on molten metal in said flow passage for drawing molten metal through said filter at a controllable rate.

* * * * *